US006988519B2

(12) United States Patent
Albrecht

(10) Patent No.: US 6,988,519 B2
(45) Date of Patent: Jan. 24, 2006

(54) FILLER DEVICE, PARTICULARLY AN OIL FILLER DEVICE ON AN INTERNAL-COMBUSTION ENGINE

(75) Inventor: Gerhard Albrecht, Vaihingen (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 67 days.

(21) Appl. No.: 10/619,602

(22) Filed: Jul. 16, 2003

(65) Prior Publication Data

US 2004/0011792 A1 Jan. 22, 2004

(30) Foreign Application Priority Data

Jul. 17, 2002 (DE) ..... 102 32 309

(51) Int. Cl.
*B65B 1/04* (2006.01)

(52) U.S. Cl. ..... 141/286; 220/86.2; 220/DIG. 33

(58) Field of Classification Search ..... 141/98, 141/67, 285, 286, 287; 220/86.1, 86.2, DIG. 33
See application file for complete search history.

(56) References Cited

U.S. PATENT DOCUMENTS 3,784,047 A 1/1974 Cooper
5,022,495 A * 6/1991 Lavender ..... 184/105.1
5,232,115 A 8/1993 Bauer
6,651,707 B2 * 11/2003 Zimmer et al. ..... 141/286
6,755,316 B2 * 6/2004 Ono et al. ..... 220/304

FOREIGN PATENT DOCUMENTS

| | | |
|---|---|---|
| DE | 2322564 | 11/1973 |
| DE | 3428472 A1 | 2/1986 |
| DE | 3927325 | 2/1991 |
| DE | 4123073 | 1/1992 |
| EP | 0917903 A1 | 5/1999 |
| EP | 1264725 A1 | 12/2002 |
| FR | 2772828 | 6/1999 |

* cited by examiner

*Primary Examiner*—Steven O. Douglas
(74) *Attorney, Agent, or Firm*—Crowell & Moring LLP

(57) ABSTRACT

A filler device, particularly an oil filler device on an internal-combustion engine, has a filler neck and a closing cap closing the filler opening on the filler neck, which closing cap has a cap bottom, a surrounding cap wall originating from the cap bottom, and a centering element arranged in the interior on the closing cap. The centering element interacts with a countercentering element situated on the filler neck. For a good centering of the closing cap on the filler neck, it is provided to arrange the countercentering element at a radial distance with respect to the interior pipe surface of the filler neck and within an end section of the filler neck in the area of the filler opening.

25 Claims, 1 Drawing Sheet

FILLER DEVICE, PARTICULARLY AN OIL FILLER DEVICE ON AN INTERNAL-COMBUSTION ENGINE

BACKGROUND AND SUMMARY OF THE INVENTION

The invention is related to a filler device, particularly an oil filler device on an internal-combustion engine, comprising a filler neck and a closing cap closing a filler opening at the filler neck, which said closing cap has a cap bottom, a surrounding cap wall originating from the cap bottom, and a centering element arranged in an interior on the closing cap, said centering element interacting with a countercentering element situated on the filler neck.

A filler device of the above-mentioned type is known from German Patent Document DE 39 27 325 C2 and corresponding U.S. Pat. No. 5,232,115. This filler device comprises a filler neck having the filler opening and a cup-shaped closing cap closing the filler opening, which closing cap has a cap bottom, a surrounding cap wall originating from the cap bottom, and a centering element which is arranged in the interior on the closing cap and which interacts with a countercentering element constructed on the filler neck. In the case of the known filler device, the centering element is constructed as a tube-shaped lengthening which is situated approximately parallel and at a radial distance with respect to the surrounding cap wall and has an outside diameter which is adapted to the inside diameter of the filler opening. No distance exists between the centering element and the interior pipe surface of the filler neck, so that the interior pipe surface forms the countercentering element.

It is an aspect of the invention to provide a filler device, in the case of which a centering of the closing cap takes place in a reliable manner independently of the filler neck.

This aspect may be achieved in that the countercentering element is situated at a radial distance with respect to an interior pipe surface of the filler neck and within an end section of the filler neck in an area of the filler opening. Additional characteristics further developing the invention and embodiments thereof are described in the subclaims and herein below.

Principal advantages achieved by way of certain preferred embodiments of the invention are that the centering is achieved in a reliable manner, which is important for a tight closing of the filler opening, of the closing cap on the filler neck, which has, for example, a tapering and/or curved course, or also in the case of relatively short filler necks. By way of the centering and by way of a separate countercentering element within the filler neck, a precise centering of the closing cap can be achieved independently of the course of the filler neck. In addition, it is advantageous that, as a result of the radial distance of the countercentering element from the interior surface of the pipe and thus also the increased distance of the centering element from the cap wall, a correspondingly large space is created for the arrangement of a sealing device which therefore permits an optimized sealing design.

According to a further development, the countercentering element is held or supported in a simple manner at a distance from the interior pipe surface by way of at least one web which extends in the radial direction.

In a construction variant, the countercentering element is optionally produced in that its web is in one piece with the filler neck. According to another construction variant, the countercentering element may also be implemented as an insert which in this manner may optionally be used on filler necks without any centering as a retrofitting.

The centering of the closing cap according to certain preferred embodiments of the invention is preferably used on filler necks which are bent at right angles, are angular, or extend in an angular fashion and/or taper and, in the case of which, the length of the end section having the filler opening would not be sufficient for guiding, in the axial direction, the centering element. The axial length of the countercentering element can therefore be selected to be larger than or equal to the length of the end section of the neck.

Other objects, advantages and novel features of the present invention will become apparent from the following detailed description of the invention when considered in conjunction with the accompanying drawings.

DETAILED DESCRIPTION OF THE DRAWINGS

Figure 1:
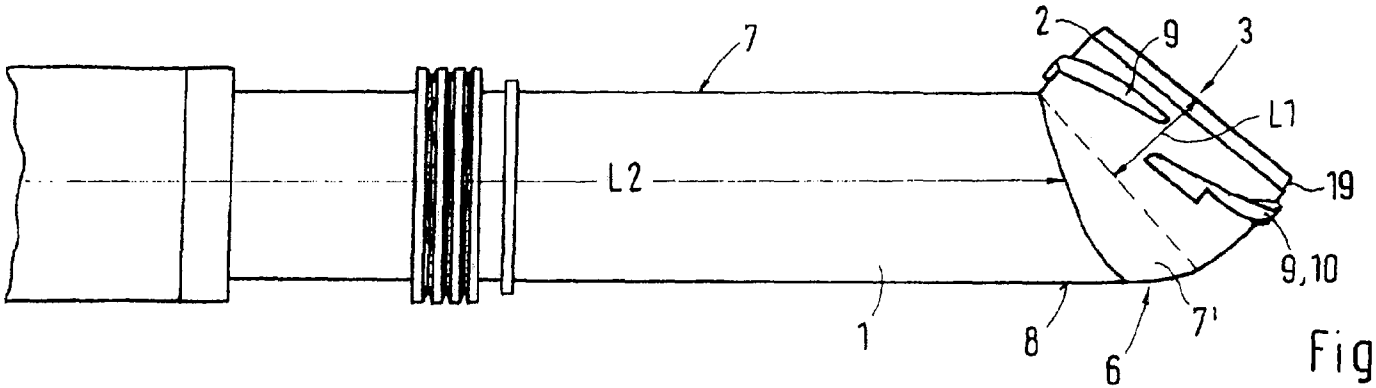
FIG. 1 shows the side view of a filler neck of a filler device.
Figure 2:
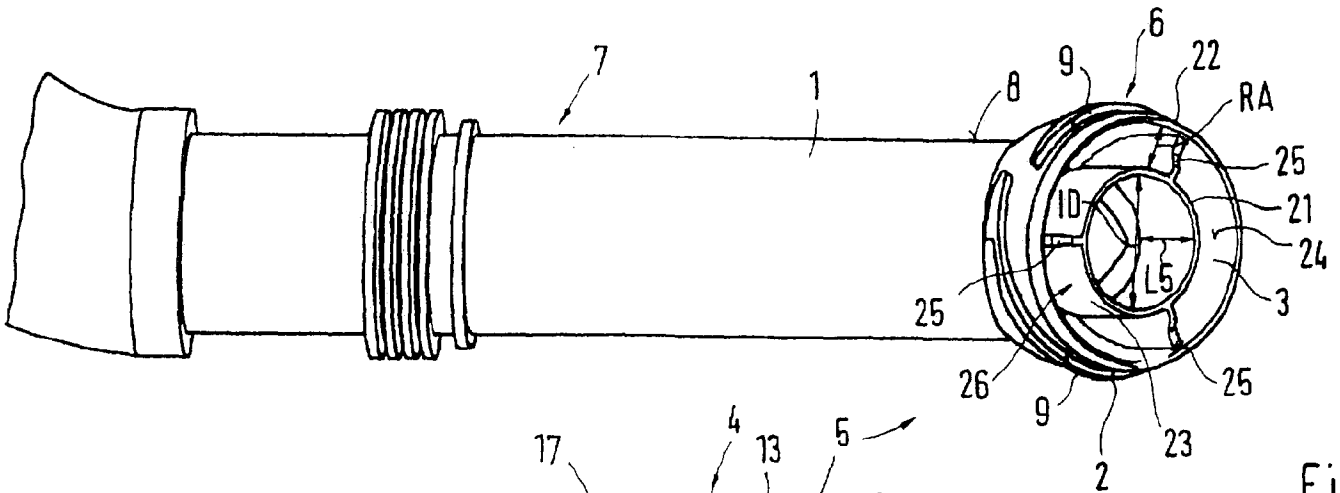
FIG. 2 shows the top view of a filler neck of a filler device.

FIG. 1 (lateral view) and FIG. 2 (perspective view) show a filler neck 1 which, by way of its one end, may be connected with a reservoir or tank and, on its other end 2, has a filler opening 3 which can be connected with a closing cap 4 (FIG. 3) by a fitting onto the filler neck 1. The closing cap 4 and the filler neck 1 form a filler device 5 which, in particular, is an oil filler device for lubricating oil of an internal-combustion engine of a motor vehicle. For this purpose, the filler neck 1 may be connected, for example, in a swivellable manner by way of its end not shown here with the internal-combustion engine.

The filler neck 1 is implemented as a pipe which extends in an angular manner in the illustrated embodiment and has the filler opening 3 at its short angular end section. The connecting section 7 of the filler neck 1 connected with the internal-combustion engine may extend in a straight manner or optionally in sections in a bent manner. The axial length L1 of the end section 6 is significantly smaller than the axial length L2 of the connecting section 7. Instead of the angular end section 6, a bent pipe section or a pipe section bent at right angles may also be provided as the end section. In addition, the end section 6—viewed from the filler opening 3 in the direction to the connecting section 7—may be constructed to be tapering and/or—as illustrated in FIG. 1—change by way of another pipe section 7' with a curve, an angle or a bending at right angles into the connecting section 7. Preferably, the filler neck 1 is produced in that its sections 6, 7, 7' are in one piece as a plastic part.

On the exterior pipe surface 8 of the filler neck 1, a first securing element 9 of a closing cap securing device 10 is constructed on the end section 6, which securing element 9 interacts with a second securing element 12 arranged on the closing cap 4, particularly on the interior cap side 11, in order to be able to fasten the closing cap 4 on the filler neck 1. The closing cap securing device 10 is preferably constructed as a screw cap or as a bayonet cap.

Figure 3:
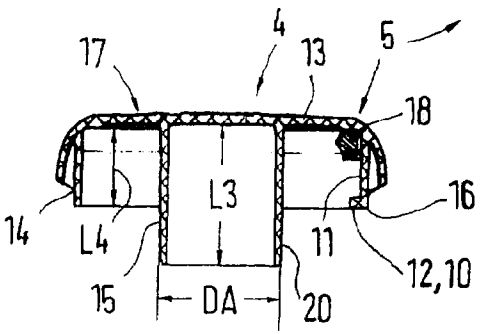
FIG. 3 shows a sectional view of a closing cap for the filler neck of the filler device according to FIGS. 1 and 2 respectively.

The cup-shaped closing cap 4 is formed by a closing bottom 13, a surrounding closing wall 14 originating from the bottom 13, and a centering element 15 arranged in the interior on the closing cap 4, thus, on the interior side 11. As illustrated in FIG. 3, the second securing element 12 is situated on the interior side 11 in the area of the closing wall 14, particularly at its free end 16, and projects radially to the interior, so that it can engage with the first securing element 9 projecting from the exterior pipe wall 8. In the transition area 17 from the bottom 13 to the wall, a surrounding sealing device 18 is also arranged on the interior side 11, which sealing device 18 may be implemented as a sealing ring and sealingly rests on a conically tapering sealing flange 19 on the end section 6. Since the inside diameter of the cap 4 is larger than the outside diameter of the neck 1 in the area of the filler opening 3, the sealing device 18 rests on the exterior pipe surface 8 when the cap 4 is fitted by way of its interior side 11 on the filler neck 1 reaching over the latter and, in the process, closes the filler opening 3. In particular, the cap 4, together with the bottom 13, the wall 14 and the centering element 15 is constructed in one piece of a plastic material.

The centering element 15, which originates on the interior side 11 at the center on the floor 13 or extends coaxially with respect to the cap wall 14 and therefore extends in the axial direction, is implemented as a first pipe piece 20 which has a circular cross-section. When the cap 4 is fitted onto the filler neck 1, the centering element 15, whose axial length L3 is greater than the axial length L4 of the closing wall 14 and therefore projects over its free end 16, engages with a countercentering element 21 arranged within the filler neck 1, whereby the cap 4 is aligned relative to the mouth edge 22 surrounding the filler opening 3 or is centered with respect to the filler opening 3.

The axial length L5 of the countercentering element 21, which is constructed as a second pipe piece 23 with a circular cross-section, may be greater than or equal to the axial length L1 of the end section 6 of the filler neck 1 because the countercentering element 21 is situated in the area of the filler opening 3 or in the end section 6 with a radial distance RA with respect to the interior pipe surface 24.

Like the centering element 15, the countercentering element 21 is arranged coaxially with respect to the surrounding wall—here, the pipe wall of the filler neck 1—so that it is situated in the center in the filler opening 3. One or more radially extending webs 25 are used as spacers between the interior pipe surface 24 and the pipe piece 23. If several webs 25 are provided, these are arranged to be distributed around the circumference of the second pipe piece 23. They may start out from the countercentering element 21 or the filler neck 1 or may be produced as separate parts. As an alternative, it is conceivable to produce the countercentering element 21 and the webs 25 in one piece with the neck 1 or to optionally produce the countercentering element 21 with its webs 25 separately and to place it as an insert 26 in the filler neck 1 and fasten it thereto, for example, by gluing.

The outside diameter DA of the centering element 15 is adapted to the inside diameter ID of the countercentering element 21; that is, DA<ID, so that the centering element 15 is, in particular, slidingly guided in the axial direction on the countercentering element 21 when the cap 4 is placed on the neck 1. Since the length L5 of the countercentering element 21 is greater than the length L1 of the end section 6, independently of the axial course (bent at right angles or angular) of the neck 1, the closing cap 4 can be axially guided along a corresponding length, which prevents a tilting of the closing cap 4. Thus, it can be fitted on in a precise position and without any tendency to tilt, so that, on the one hand, the two securing elements 9 and 12 reliably engage in one another and, on the other hand, the sealing device 18 comes to be situated in the correct position with respect to the sealing flange 19. However, it is also conceivable that the securing element 12 acts as an additional centering device together with the exterior pipe surface 8 if the centering element 15 is pushed correspondingly far into the countercentering element 21. In the case of this additional centering, the countercentering element 21 could also be further developed to be shorter than the end section 6. As a result of the fact that the countercentering element 21 or the second pipe piece 23 is situated at a distance RA coaxially within the filler neck 1, the countercentering element 21 can project into the connecting section 7, which permits a long axial guidance of the centering element 15.

What is claimed is:

1. Filler device, comprising a filler neck and a closing cap closing a filler opening at the filler neck, which said closing cap has a cap bottom, a surrounding cap wall originating from the cap bottom, and a centering element arranged in an interior on the closing cap, said centering element interacting with a countercentering element situated on the filler neck, wherein the countercentering element is situated at a radial distance with respect to an interior pipe surface of the filler neck and within an end section of the filler neck in an area of the filler opening, wherein a surrounding sealing device is situated on the interior side of the closing cap in a transition area between the bottom and the wall, wherein the inside diameter of the closing cap is larger than the outside diameter of the filler neck, and wherein, when the closing cap is fitted on, the sealing device comes to rest on the exterior pipe surface of the filler neck.

2. Filler device according to claim 1, wherein the filler device is adapted to communicate oil to an engine.

3. Filler device according to claim 1, wherein the centering element is constructed as a first pipe piece with a circular cross-section and the countercentering element is constructed as a second pipe piece with a circular cross-section, the centering element and the countercentering element being situated concentrically in one another when the closing cap is fitted onto the filler neck.

4. Filler device according to claim 3, wherein an outside diameter of the first pipe piece for the centering is correspondingly smaller than an inside diameter of the second pipe piece.

5. Filler device according to claim 1, wherein the centering element is constructed in one piece with the closing cap.

6. Filler device according to claim 3, wherein the centering element is constructed in one piece with the closing cap.

7. Filler device according to claim 1, wherein the countercentering element is supported by way of at least one web with respect to the interior pipe surface at the radical distance.

8. Filler device according to claim 3, wherein the countercentering element is supported by way of at least one web with respect to the interior pipe surface at the radical distance.

9. Filler device according to claim 1, wherein the countercentering element is constructed in one piece with the filler neck.

10. Filler device according to claim 7, wherein the countercentering element and the web are constructed in one piece with the filler neck.

11. Filler device according to claim 5, wherein the countercentering element is constructed in one piece with the filler neck.

12. Filler device according to claim 3, wherein the countercentering element is constructed in one piece with the filler neck.

13. Filler device according to claim 1, wherein the countercentering element is constructed as an insert for the filler neck.

14. Filler device according to claim 7, wherein the countercentering element and the web are constructed as an insert for the filler neck.

15. Filler device according to claim 1, wherein, at the end section having the filler opening, the filler neck, viewed from the filler opening, has a right-angle bend, an angle or a curve, or tapers.

16. Filler device according to claim 1, wherein the axial length of the centering element is identical to or greater than the axial length of the end section.

17. Filler device according to claim 3, wherein the axial length of the centering element is identical to or greater than the axial length of the end section.

18. Filler device according to claim 7, wherein the axial length of the centering element is identical to or greater than the axial length of the end section.

19. Filler device according to claim 3, wherein the second pipe piece is arranged coaxially within the filler neck.

20. Filler device according to claim 1, wherein the closing cap is secured on the filler neck in a manner of a screw cap or a bayonet cap.

21. A method of using a filler device comprising utilizing the filler device of claim 1 to communicate oil to an engine.

22. An oil filler assembly for an engine, comprising:

a pipe connectable to an oil inlet of the engine, said pipe having an opening, a cap being adapted to close and seal the opening and having a cap base surrounded by a cap wall and a centering element arranged inside the cap, and a countercentering element being arranged at a radial distance from an interior surface of the pipe and at an end of the pipe adjacent the opening, the centering element and countercentering element being adapted to interface with one another, wherein a surrounding sealing device is situated on the interior side of the closing cap in a transition area between the bottom and the wall, wherein the inside diameter of the closing cap is larger than the outside diameter of the filler neck, and wherein, when the closing cap is fitted on, the sealing device comes to rest on the exterior pipe surface of the filler neck.

23. Filler device according to claim 1, wherein said filler neck has a conically tapering flange surrounding said filler opening, and wherein said sealing device is a sealing ring which sealingly rests on the flange when the cap is in a position closing said opening.

24. A method of making the filler device of claim 1, comprising:

forming the cap as a one piece plastic part, and forming the filler neck and countercentering element as a one piece plastic part.

25. A method making the filler device of claim 1, comprising:

forming the filler neck as a first plastic part, forming the countercentering element as one piece with radially extending webs and, gluing the webs to the filler neck.

* * * * *